United States Patent [19]

Kommrusch

[11] Patent Number: 4,965,537

[45] Date of Patent: Oct. 23, 1990

[54] TUNELESS MONOLITHIC CERAMIC FILTER MANUFACTURED BY USING AN ART-WORK MASK PROCESS

[75] Inventor: Richard S. Kommrusch, Schaumburg, Ill.

[73] Assignee: Motorola Inc., Schaumburg, Ill.

[21] Appl. No.: 452,077

[22] Filed: Dec. 18, 1989

Related U.S. Application Data

[63] Continuation of Ser. No. 202,623, Jun. 6, 1988, abandoned.

[51] Int. Cl.[5] ..... H01P 1/202

[52] U.S. Cl. ..... 333/202; 333/207; 333/223; 29/600

[58] Field of Search ..... 333/206, 207, 202, 203, 333/222, 223; 29/600, 601

[56] References Cited

U.S. PATENT DOCUMENTS

| | | | |
|---|---|---|---|
| 4,462,098 | 7/1984 | D'Avello et al. | 370/30 |
| 4,692,725 | 9/1987 | Fukasawa et al. | 333/207 X |
| 4,692,726 | 9/1987 | Green et al. | 333/206 |
| 4,757,288 | 7/1988 | West | 333/206 |

FOREIGN PATENT DOCUMENTS

| | | | |
|---|---|---|---|
| 52-102 | 3/1985 | Japan | 333/223 |
| 42903 | 3/1985 | Japan | 333/208 |
| 167201 | 7/1986 | Japan | 333/203 |

*Primary Examiner*—Benny Lee

*Attorney, Agent, or Firm*—Rolland R. Hackbart

[57] ABSTRACT

A ceramic filter employs a novel tuning process which avoids the necessity of etching or abrading plating on the surface of the filter. The tuning is provided by determining a selected frequency related characteristic of the dielectric making up the block portion of the ceramic filter. For example, the quarter wave length frequency of the block may be measured. Next, plating artwork is designed in accordance with the determined selected frequency related characteristic. The artwork is then used for selectively applying a conductive material to a surface of the block in order to shift the determined selected frequency related characteristic to a desired (specified) frequency characteristic. By appropriately designing the artwork based on the determined selected frequency related characteristic, no etching or abrading to the plating on the block is required.

6 Claims, 1 Drawing Sheet

TUNELESS MONOLITHIC CERAMIC FILTER MANUFACTURED BY USING AN ART-WORK MASK PROCESS

FIELD OF THE INVENTION

The present invention relates generally to radio-frequency (RF) signal filters, and, more particularly, to the practice of tuning ceramic RF signal filters.

DESCRIPTION OF THE PRIOR ART

Conventional multi-resonator ceramic filters include a plurality of resonators that are typically foreshortened short-circuited quarter wavelength coaxial or helical transmission lines. The resonators are arranged in a conductive enclosure and may be coupled one to another by apertures in their common walls. Each resonator is commonly tuned to the desired response characteristics in one of two ways.

One way of tuning such resonators is by employing a tuning screw which inserts into a hole extending through the middle of the resonator. Unfortunately, the tuning screw is bulky, it requires mechanical locking elements which can offset the desired coupling between resonators, and, due to the adjustability of the screw before it is locked, it renders these filters susceptible to becoming detuned.

Another way of tuning each resonator is by plating one surface of the ceramic filter at each resonator with conductive plating material. Typically, the surface is plated between the hole in the middle of the resonator and a side wall coupled to the conductive enclosure. This plating is then etched (abraded) away for each resonator in the filter until the desired response characteristics are obtained. This approach is disadvantageous in that it is extremely labor intensive. Plating at each resonator must be repeatedly etched and tested for the desired response characteristics. If too much plating is removed, the filter must be replated or discarded. Moreover, etching the plating often results in etching away some of the ceramic material of the resonator which degrades the coupling consistency between the resonators.

For these reasons, a tuning technique for a ceramic filter is needed which overcomes the foregoing deficiencies.

OBJECTS OF THE INVENTION

It is a general object of the present invention to provide a tuning technique for a ceramic filter which overcomes the above-mentioned shortcomings.

It is a more particular object of the present invention to provide a pretuned ceramic filter which employs predesigned artwork to implement the plating of the top surface of the filter for such tuning.

It is another object of the present invention to provide such a ceramic filter for a duplexer.

BRIEF DESCRIPTION OF THE DRAWINGS

The features of the present invention which are believed to be novel are set forth with particularity in the appended claims. The invention, together with further objects and advantages thereof, may best be understood by making reference to the following description taken together with the accompanying drawings, in which reference numerals identify the elements, and wherein:

DETAILED DESCRIPTION OF THE PREFERRED EMBODIMENT

The arrangement disclosed in this specification has particular use for filtering signals in a radio frequency (RF) communication system. More particularly, the arrangement disclosed herein is directed to the manufacture of ceramic filters, their implementation as a duplexer in a radio transceiver.

Figure 1:
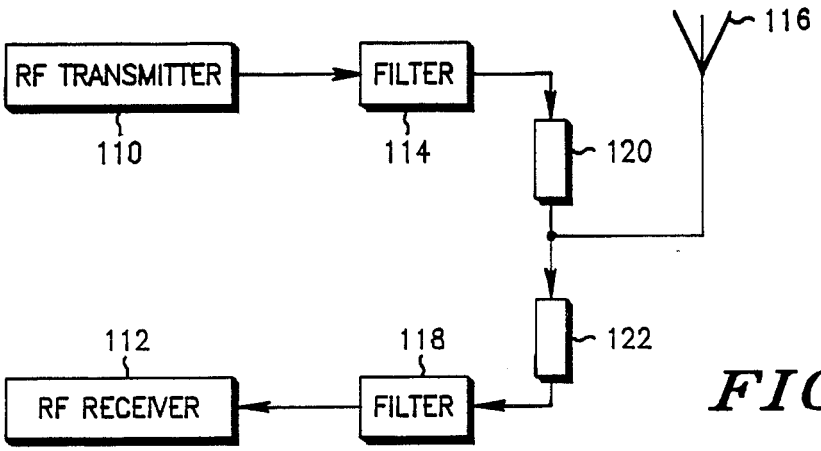
FIG. 1 is a diagram of a RF radio transceiver employing two filters, according to the present invention.

FIG. 1 illustrates such a transceiver. The transceiver includes a conventional RF transmitter 110, and a conventional RF receiver 112. A novel ceramic filter 114, according to the present invention, is used to couple a transmit RF signal from the RF transmitter 110 to an antenna 116. A similar novel ceramic filter 118 is employed between the antenna 116 and the RF receiver 112 to couple a received RF signal from the antenna 116 to the RF receiver 112. Together, the filters 114 and 118 function as a duplexer to intercouple the antenna 116 to the transceiver. Transmission lines 120 and 122 are respectively disposed between the ceramic filters 114 and 118 and the antenna 116 for proper electrical coupling.

The passband of the filter 114 is centered about the frequency of the transmit RF signal from RF transmitter 110, while at the same time greatly attenuating the frequency of the received RF signal. In addition, the length of transmission line 120 is selected to maximize its impedance at the frequency of the received signal.

The passband of the filter 118 is centered about the frequency of the received RF signal, while at the same time greatly attenuating the transmit signal. The length of transmission line 122 is selected to maximize its impedance at the transmit RF signal frequency.

Alternatively, the filters 114 and 118 with elements 120 and 122 can be combined onto a single dielectric block.

Figure 2:
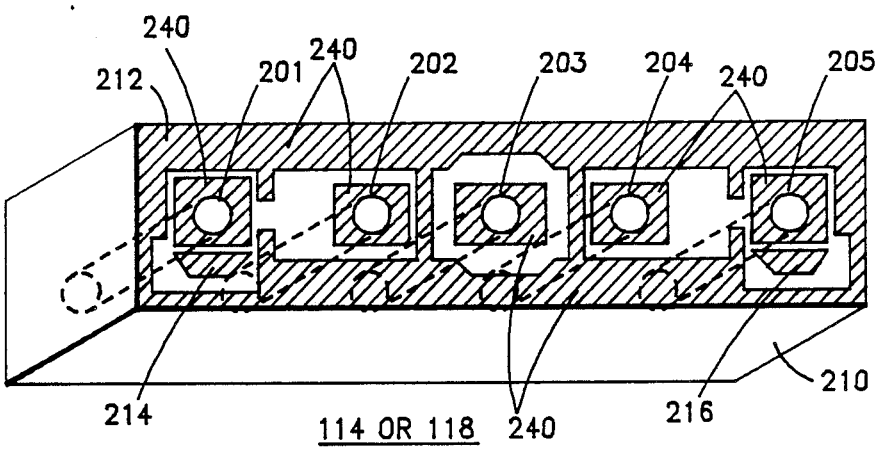
FIG. 2 is an expanded diagram of one of the filters 114 or 118 of FIG. 1, according to the present invention.

In FIG. 2, the filter 114 or 118 is shown in detail, according to the present invention. The filter 114 or 118 includes a block 210 which is comprised of a dielectric material that is selectively plated with a conductive material. The block 210 includes input and output electrodes 214 and 216 plated thereon for receiving an input RF signal and for passing a filtered RF signal, respectively. RF signals can be coupled to the electrodes 214 and 216 of the filter 114 or 118 by conventional circuits such as those discussed in U.S. Pat. No. 4,431,977, Sokola et al., assigned to the same assignee and incorporated herein by reference.

The plating on block 210 is electrically conductive, preferably copper, silver or an alloy thereof. Such plating preferably covers all surfaces of the block 210 with the exception of the top surface 212, the plating of which is discussed below. Of course, other conductive plating arrangements can be utilized. See, for example, those discussed in "Ceramic Bandpass Filter", U.S. Pat. No. 4,431,977, Sokola et al., assignee to the present assignee and incorporated herein by reference.

Block 210 includes five holes 201–205, each of which extends from the top surface to the bottom surface thereof. The surfaces defining holes 201–205 are likewise plated with an electrically conductive material.

Each of the plated holes 201–205 is essentially a transmission line resonator comprised of a short-circuited coaxial transmission line having a length selected for desired filter response characteristics. Although block 210 is shown with five plated holes 201–207, any number of plated holes can be utilized depending on the filter response characteristics desired. For additional description of the holes 201–205, reference may be made to U.S. Pat. No. 4,431,977, Sokola et al., supra.

Of course, such holes are not essential to filter operation in ceramic filters. For example, ceramic waveguide filters sometimes include resonating section(s) without holes through the dielectric block. See, for example, U.S. Pat. No. 4,691,179, Blum et al., assigned to the same assignee and incorporated herein by reference.

Coupling between the transmission line resonators, provided by the plated holes 201–205, in FIG. 2 is accomplished through the dielectric material and is coursely adjusted by varying the effective width of the dielectric material and the distance between adjacent transmission line resonators. The effective width of the dielectric material between adjacent holes 201–205 can be adjusted in any suitable regular or irregular manner; for example, by the use of slots, cylindrical holes, square or rectangular holes, or irregular shaped holes.

Fine adjustments are made according to the predesigned artwork plating as discussed below.

Figure 3:
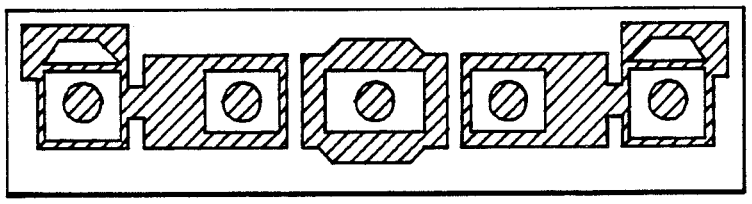
FIG. 3 is a diagram of an artwork mask, according to the present invention.

Furthermore, plated or unplated holes located between the transmission line resonators, provided by holes 201–205, can also be utilized for adjusting the coupling. According to the present invention, a top surface 212 of the block 210 is selectively plated with a similar electricallY conductive material (plating) 240, .indicated by shaded areas. The unplated areas of the top surface 212, gaps between the plated areas, are indicated by the unshaded areas. The plating 240 on the top surface of block 210 or FIG. 2 is disposed on the block 210 by using a predesigned artwork mask 310 (FIG. 3), in accordance. with the present invention.

The unique mask design is based upon a selected frequency related characteristic of the base dielectric block. Reference to the term "base dielectric block", using FIG. 2 for example, indicates that the block 210 is in a basic form in that there is no plating on the top surface 212. Preferably, the selected frequency related characteristic includes the quarter wave length frequency of the base dielectric block. Alternatively, the height and/or the electric constant of the base dielectric block can be used.

The base dielectric block can be constructed of a suitable dielectric material that has low loss, a high dielectric-constant and a low temperature coefficient of the dielectric constant. In a preferred embodiment, the base dielectric block of block 210 is comprised of a ceramic compound including barium oxide, titanium oxide and zirconium oxide, the electrical characteristics of which are described in more detail in an article by G. H. Jonker and W. Kwestroo, entitled "The Ternary Systems $BzO+TiO_2+SnO_2$ and $BaO+TiO_2+ZrO_2$", published in the Journal of the American Ceramic Society, volume 41, number 10, at pages 390–394, Oct. 1958. Of the ceramic compounds described in this article, the compound in Table VI having the composition 18.5 mole % BaO, 77.0 mole % $TiO_2$ and 4.5 mole % $ZrO_2$ and having a dielectric constant of 40 is well suited for use in the ceramic filter of the present invention.

Such dielectric material is preferably employed as a batch, useful for developing a large number of base dielectric blocks. One batch of such dielectric material, when appropriately used, will provide an equal distribution of the elements making up the compound. An equal distribution will ensure almost exact frequency related characteristics throughout the base dielectric blocks produced therefrom. For example, variance of the quarter wavelength resonant frequency is negligible (measured at less than 0.4% in one application) between the blocks produced from the same batch. However, such a characteristic may be measured on various samples from the batch to ensure consistency.

Once a base dielectric block is produced from the batch, the selected frequency related characteristic is measured to determine the representative frequency related characteristic for the batch or a substantial portion thereof.

Based partly on the representative frequency related characteristic and partly on externally developed filter design specifications, plating artwork useful for selectively plating the conductive material to the top surface of the blocks is designed and then applied to the base dielectric block to provide a complete filter with customized filter characteristics. Preferably, the artwork is developed using conventional computer program modeling and model-to-circuit translations, such as the program entitled "Super-Compact", available from Compact Software, Inc.

The manner in which the plating artwork is used to apply the plating to the base dielectric block can be accomplished using conventional means. For example, an adequate technique uses a dry film imaging transfer system as Riston® Du Pont Electronics, Inc., subsidiary of E.I. Du Pont De Nemours ® Co. (Inc.).

Variance of the frequency related characteristic between batches can be accommodated by designing several artwork masks to represent needed shifts of the desired center frequency of the filter. For example, consider a quarter wave length base dielectric block frequency of 1 GHz. and a desired filter center frequency of 836.5 MHz. The artwork will be designed to shift the quarter wave length frequency down to 836.5 MHz. However, various batches may result in a quarter wave length base dielectric block frequencies which vary from 0.990 GHz. to 1.010 GHz. (20 MHz. variance). By designing 7 artwork masks, each maybe designed to shift a quarter wave length base dielectric block frequency as below:

| Artwork | Shift from | Shift to |
|---|---|---|
| 1 | 1.010 GHz. | 836.5 MHz. |
| 2 | 1.007 GHz. | 836.5 MHz. |
| 3 | 1.004 GHz. | 836.5 MHz. |
| 4 | 1.001 GHz. | 836.5 MHz. |
| 5 | 0.998 GHz. | 836.5 MHz. |
| 6 | 0.995 GHz. | 836.5 MHz. |
| 7 | 0.992 GHz. | 836.5 MHz. |

In this manner, a 20 MHz. variance from one batch to the next may be compensated to within 3 Mhz. accuracy by measuring the quarter wavelength frequency characteristic and then selecting the appropriate artwork mask with which to apply the block plating.

Accordingly, where the resonant quarter wavelength frequency of the block is used as the selected frequency related characteristic, the plating artwork is developed to shift the resonant frequency of the block down to the specified center resonant frequency for the filter design. This processing technique provides significant advantages over the prior art previously discussed. For example, a 12 block study of screen printed and tuned filters included frequency, gap and coupling coefficient measurements. The filters met the desired insertion loss and attenuation specifications as well as better than by abrasive conventional tuning techniques.

It will be understood by those skilled in the art that various modifications and changes may be made to the present invention without departing from the spirit and scope thereof.

What is claimed is:

1. A method of filter manufacture, comprising the steps of:

producing dielectric means comprised of a dielectric material having top, side, and bottom surfaces, forming in said dielectric means at least two holes extending from the top surface toward the bottom surface thereof and spatially disposed at a predetermined distance from one another, selectively covering the side and bottom surfaces of said dielectric means and said at least two holes with a conductive material to provide a transmission line resonator for each of said at least two holes, said method comprising the steps of:

measuring the value of a pre-selected frequency related characteristic of said dielectric means;

forming a plurality of artwork masks, each artwork mask being formed with different patterns which correspond to a range of values of the pre-selected frequency related characteristic;

selecting from the plurality of artwork masks one artwork mask which corresponds to a range of values including the measured value of the pre-selected frequency related characteristic; and applying conductive material to the top surface of said dielectric means in accordance with the pattern of the selected one of said plurality of artwork masks, whereby no additional tuning by removal of conductive material on the top surface of said dielectric is required.

2. A method, according to claim 1, wherein the step of measuring the value of the pre-selected frequency related characteristic includes the step of measuring the value of the quarter wave length frequency of said dielectric means.

3. A method, according to claim 1, wherein the step of producing said dielectric means includes the step of plating the surfaces of said at least two holes with the conductive material.

4. A method, according to claim 1, wherein the step of measuring the value of the pre-selected frequency related characteristic includes the step of measuring the value of the distance between the top and bottom surfaces of said dielectric means.

5. A method, according to claim 1, wherein the step of measuring the value of the pre-selected frequency related characteristic includes the step of measuring the value of the dielectric constant of said dielectric means.

6. A method, according to claim 1, wherein the step of measuring the value of the pre-selected frequency related characteristic includes the step of measuring the value of the dielectric constant and the distance between the top and bottom surfaces of said dielectric means.

* * * * *